US011193313B2

(12) United States Patent
Olkay et al.

(10) Patent No.: US 11,193,313 B2
(45) Date of Patent: Dec. 7, 2021

(54) ELECTROMECHANICAL CLOSURE HAVING A ROTARY LATCH ARRANGEMENT WITH AN EVALUATABLE DOOR CONTACT FOR CONTROLLING A DISPLAY DEVICE SUCH AS AN LED MODULE

(71) Applicant: DIRAK Dieter Ramsauer Konstruktionselemente GmbH, Ennepetal (DE)

(72) Inventors: Cem Olkay, Witten (DE); Daniel Krause, Witten (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 326 days.

(21) Appl. No.: 16/334,522

(22) PCT Filed: Sep. 14, 2017

(86) PCT No.: PCT/EP2017/001090
§ 371 (c)(1),
(2) Date: Mar. 19, 2019

(87) PCT Pub. No.: WO2018/054528
PCT Pub. Date: Mar. 29, 2018

(65) Prior Publication Data

US 2020/0256096 A1 Aug. 13, 2020

(30) Foreign Application Priority Data

Sep. 22, 2016 (DE) ..... 20 2016 005 816.6
Sep. 22, 2016 (DE) ..... 20 2016 005 817.8

(51) Int. Cl.
*E05C 3/04* (2006.01)
*E05B 47/00* (2006.01)
(Continued)

(52) U.S. Cl.
CPC ..... *E05C 3/042* (2013.01); *E05B 47/0012* (2013.01); *E05B 17/226* (2013.01);
(Continued)

(58) Field of Classification Search
CPC ..... E05C 3/042; E05C 19/16; E05C 19/161; E05C 19/163; E05C 19/166;
(Continued)

(56) References Cited

U.S. PATENT DOCUMENTS 3,418,018 A * 12/1968 Marburger ..... E05C 19/16 292/251.5
5,485,733 A * 1/1996 Hoffman ..... E05B 47/004 70/276
(Continued)

FOREIGN PATENT DOCUMENTS

CN 101054864 A 10/2007
CN 101525961 A 9/2009
(Continued)

*Primary Examiner* — Lloyd A Gall
(74) *Attorney, Agent, or Firm* — The Webb Law Firm

(57) ABSTRACT

The disclosure relates to a closure system, comprising a locking arrangement, in particular a rotary latch arrangement for controlling a display device such as a LED module, comprising a sliding shoe, which is to be placed on the locking tongue of a rotary latch mounted in a door, for running onto a sliding ramp supported by the door frame, wherein said sliding shoe includes a housing with a recess for the insertion of alternatively a magnet or a magnetic field sensor acting in a contactless manner.

4 Claims, 10 Drawing Sheets

(51) Int. Cl.
*E05B 45/06* (2006.01)
*E05B 17/22* (2006.01)
*E05B 47/06* (2006.01)

(52) U.S. Cl.
CPC ... *E05B 47/0673* (2013.01); *E05B 2045/0665* (2013.01); *E05B 2047/0069* (2013.01)

(58) Field of Classification Search
CPC ..... E05C 19/168; E05B 47/0012; E05B 2045/0665; E05B 2047/0069; E05B 17/226; E05B 2047/0094; E05B 2047/0067; E05B 17/22; E05B 41/00; E05B 47/0046; E05B 47/0673
USPC ..... 70/276, 413, 432; 292/251.5
See application file for complete search history.

(56) References Cited

U.S. PATENT DOCUMENTS 6,076,385 A * 6/2000 Pedroso ..... E05B 47/0012 292/144
7,405,927 B2 * 7/2008 Lev ..... E05C 19/163 292/121
8,491,020 B2 * 7/2013 Lopes ..... E05C 3/042 292/194
2004/0041414 A1 * 3/2004 Mandall ..... E05C 19/166 292/251.5
2005/0023841 A1 * 2/2005 Chen ..... G06F 1/1616 292/251.5
2006/0175842 A1 * 8/2006 Saitoh ..... E05C 19/163 292/251.5
2007/0240463 A1 10/2007 Antonucci
2009/0115204 A1 * 5/2009 Rycroft ..... E05C 3/043 292/341.17
2016/0090753 A1 3/2016 Piantek et al.
2017/0306648 A1 10/2017 Ramsauer et al.

FOREIGN PATENT DOCUMENTS

CN 201730416 U 2/2011
CN 204960547 U 1/2016
DE 10017217 A1 10/2001
DE 202008003720 U1 9/2009
DE 202011103840 U1 1/2012
DE 202016003588 U1 10/2017
EP 0945571 A1 9/1999
EP 2138655 A1 12/2009
WO 2007140548 A1 12/2007
WO 2016045763 A1 3/2016
WO 2016049461 A1 3/2016

* cited by examiner

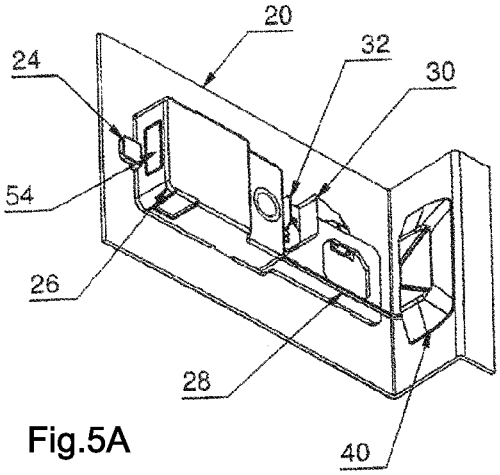
Fig.5A
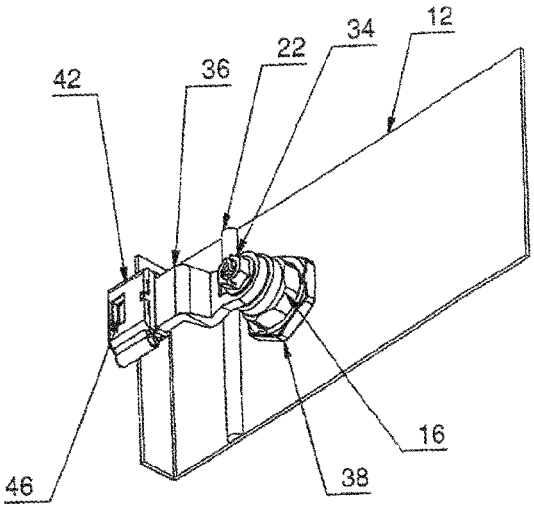
Fig.5C
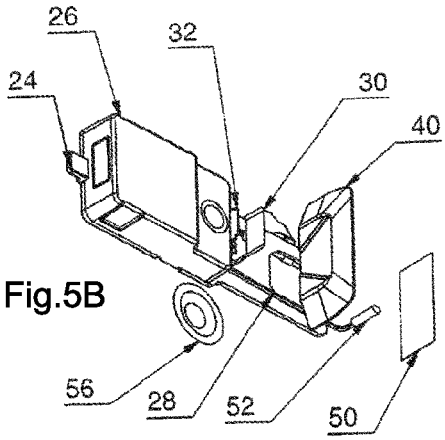
Fig.5B
Fig.5D
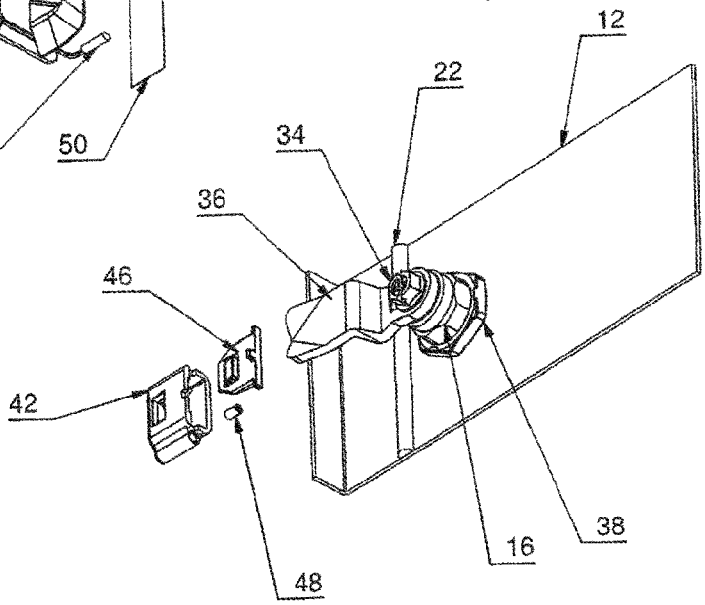

Fig.6A
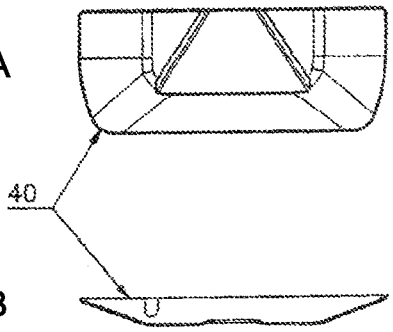
Fig.6B
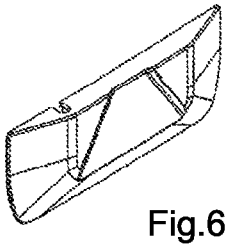
Fig.6D
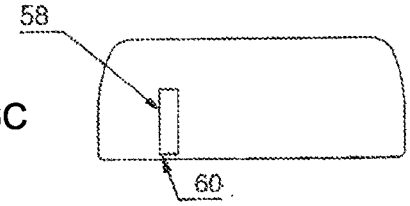
Fig.6C
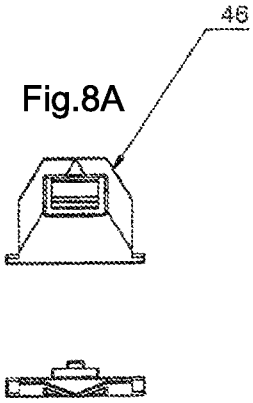
Fig.8A
Fig.8B
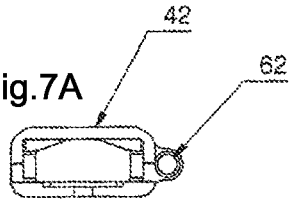
Fig.7A
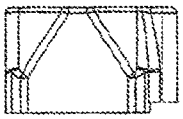
Fig.7B
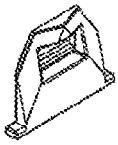
Fig.8C
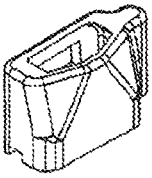
Fig.7C

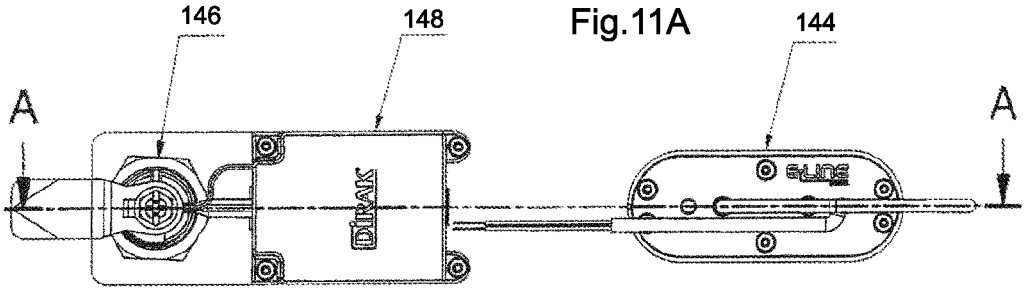
Fig.11A
A-A
Fig.11B
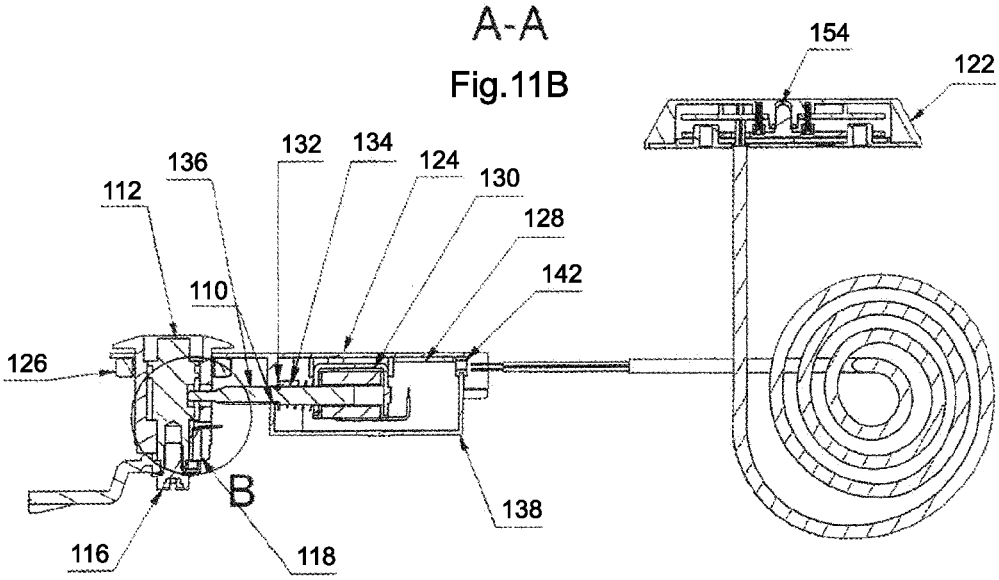
B ( 1 : 1 )
Fig.12
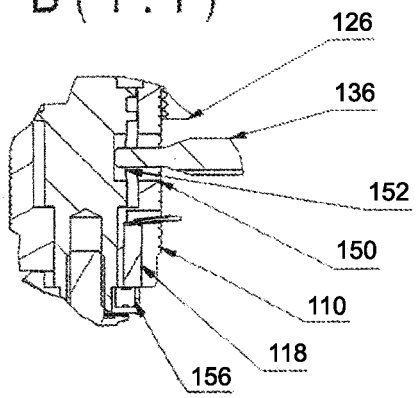

ELECTROMECHANICAL CLOSURE HAVING A ROTARY LATCH ARRANGEMENT WITH AN EVALUATABLE DOOR CONTACT FOR CONTROLLING A DISPLAY DEVICE SUCH AS AN LED MODULE

CROSS-REFERENCE TO RELATED APPLICATIONS

This application is the United States national phase of International Application No. PCT/EP2017/001090 filed Sep. 14, 2017, and claims priority to German Utility Model Application Nos. 20 2016 005 816.6 and 20 2016 005 817.8, both filed Sep. 22, 2016, the disclosures of which are hereby incorporated by reference in their entirety.

BACKGROUND OF THE INVENTION

Field of the Invention

The invention relates to a manually operable electromechanical closure, in particular a rotary latch closure (or compression latch), having a mechanical locking device, which blocks manual operation, but which can be electronically triggered.

However, the invention also relates to a locking arrangement for such a closure, in the particular a rotary latch device or rotary bolt tensioning fastener with evaluatable door contact, for controlling a display device such as a LED module.

Prior Art

An electromechanical closure of the abovementioned type is already known from DE 100 17 217 A1. Reference is also made to DE 20 2011 103 840, EP 0945571 A1 and DE 20 2008 003 720 U1.

A Sensor arrangement, which detects the position of the latch of a closure arrangement and outputs a signal, indicating the status of the latch, is known. By way of example, reference is made to the abovementioned DE 20 2008 003 720 U1, and FIG. 2, and 9A to 9C thereof, in which a locking bar of a cylinder displaceable with the thumb is provided with a sensor 18, which in turn serves for the control of other devices.

OBJECT OF THE INVENTION

The object of the invention is to provide an electromechanical closure of the abovementioned type, which offers further control possibilities and in particular is able to indicate the blocking of the closure.

The sensor device shall also be designed so that it can be assembled and fitted with greater ease and flexibility.

SUMMARY OF THE INVENTION

Solution to the Object

The object is achieved according to the invention in that a sensor detects the position of the blocking and provides this to a control device for further processing.

This takes place with a sliding shoe, which is to be placed on the locking tongue of a rotary latch mounted in a door, for running onto a sliding ramp supported by the door frame, wherein the sliding ramp and/or the sliding shoe forms a housing with a recess for the insertion of alternatively a magnet or a magnetic field sensor acting in a contactless manner. Thanks to the sliding shoe, the rotary latch has a smooth operation, and in addition an adapter allows placement on the locking tongue and thereby greater flexibility. Here, rotary latches are able to run onto a sliding ramp supported by the door frame, wherein in particular the sliding shoe includes a housing with a recess, for insertion of alternatively a magnet or a magnetic field sensor acting in contactless manner.

According to a development of the invention, the sliding ramp is also provided with a recess for accommodating alternatively also a magnetic field sensor acting in a contactless manner or a magnet.

According to another embodiment again, the sliding ramp has an adhesive surface on the frame side of the housing, with which the housing of the sliding ramp is affixed to the door frame.

Finally, a rotary latch arrangement is also provided, in which the housing of the rotary latch retains a base plate, supporting a LED, together with LED control electronics, which indicates the convergence of the magnet and the magnetic field sensor by means of a light signal, and thus provides an indication of the position of the tongue on the ramp.

According to a development of the invention, the mechanical locking is formed by a plunger extendable by means of a lowering magnet against a spring force, or adjustable by an electric motor, such as a servomotor.

Where a plunger is present, a development is possible in that the closure has a housing with an opening for the plunger, represented by an elongated hole in axial alignment with the rotational axis of the closure.

According to a development of the electromechanical closure, the housing is a printed circuit board with electronics for switching the closure, which also includes the locking and sensors such as, for example, contactless sensors (e.g. read sensors) for detecting the blocking state.

It is beneficial if the housing of the drive unit and the housing of the printed circuit board are combined to form one housing.

It is also beneficial if the tongue of the closure includes a sliding shoe and a ramp. In this case, the ramp can be provided with a magnet, which is detected by a sensor in a sliding shoe, in order in this way to receive a signal on the locking state of the drive.

BRIEF DESCRIPTION OF THE DRAWINGS

These show as follows:

FIG. 5A a perspective view of parts mounted on the door frame of the closure according to the invention, according to an alternative arrangement;

FIG. 5B the parts of FIG. 5A, prior to mounting;

FIG. 5C the parts which in this alternative are mounted on the door leaf;

FIG. 5D the parts of FIG. 5C in exploded view;

FIGS. 6A, 6B, 6C and 6D various views of the sliding ramp;

FIG. 7A, 7B, 7C various views of the sliding shoe;

FIG. 8A, 8B, 8C various views of an adapter for the arrangement of the sliding shoe;

FIG. 11A a top view of the arrangement of FIG. 9;

FIG. 11B a sectional view along the line of intersection A-A of FIG. 11A;

FIG. 12 an enlarged representation of an individual part, which in FIG. 11B is identified in the centre;

DETAILED DESCRIPTION OF THE INVENTION

A Particularly Advantageous Embodiment

Figure 1:
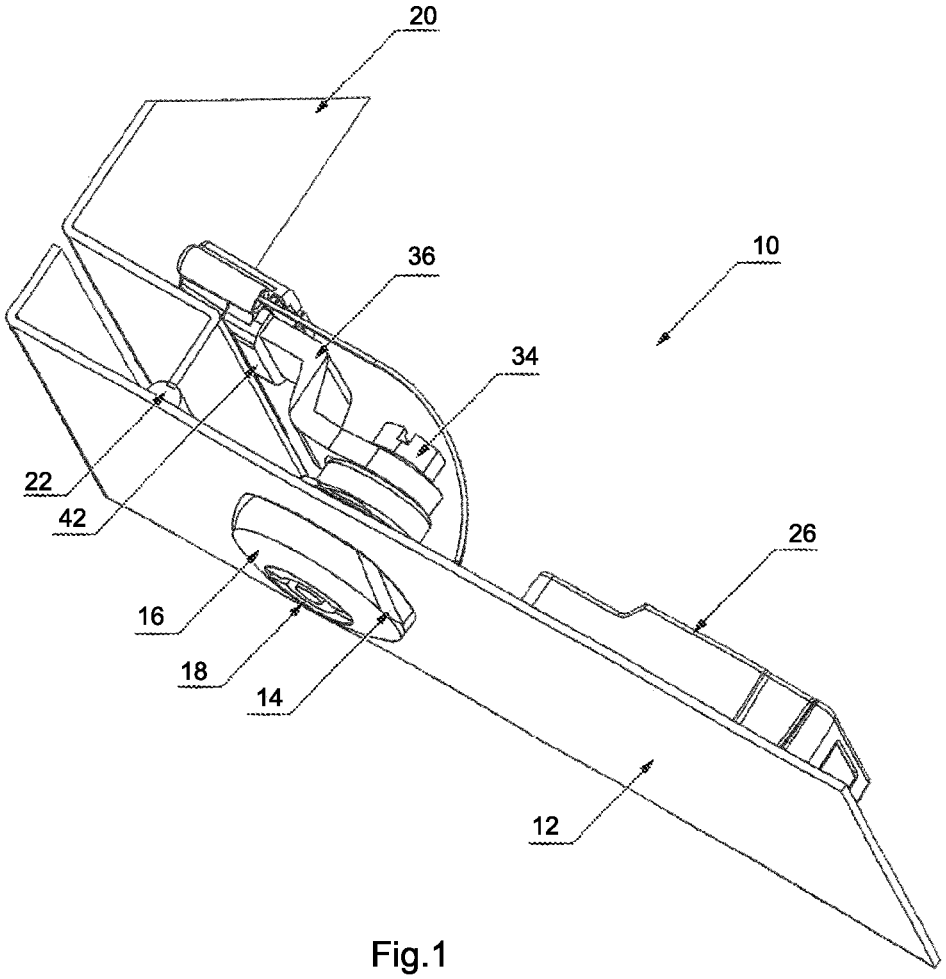
FIG. 1 a perspective view of a rotary latch arrangement constructed in accordance with the invention with evaluatable door contact.
Figure 2A:
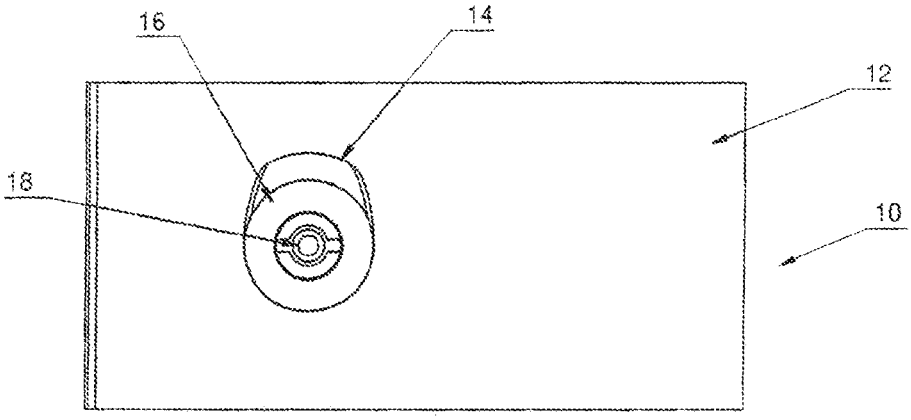
FIG. 2A a top view of the arrangement of FIG. 1.
Figure 2B:
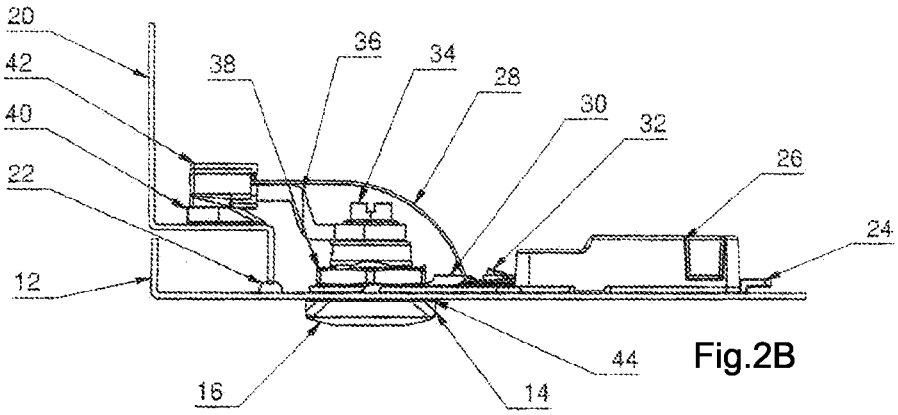
FIG. 2B a side view of the arrangement according to FIG. 1.
Figure 2C:
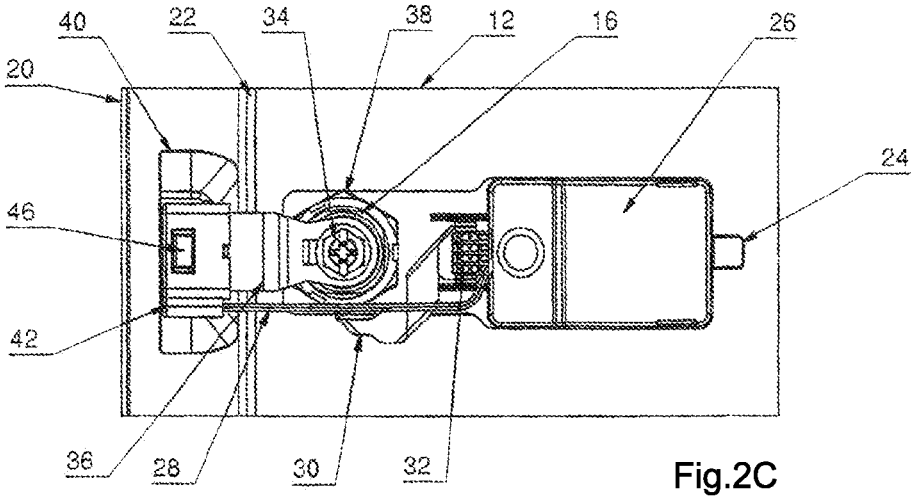
FIG. 2C a rear view of the arrangement according to FIG. 1.
Figure 3A:
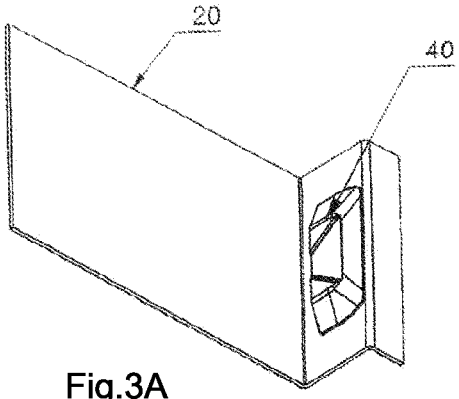
FIG. 3A the door frame section with the sliding ramp of the arrangement according to the invention in a perspective view from the front.
Figure 3B:
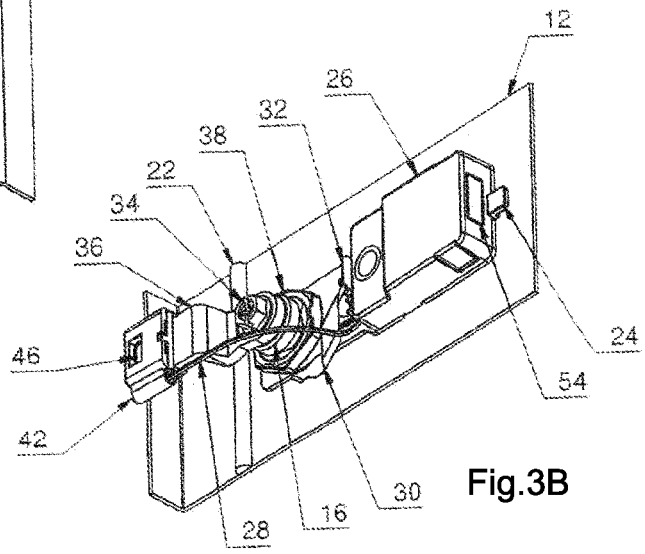
FIG. 3B the door leaf section with the rotary latch closure.
Figure 3C:
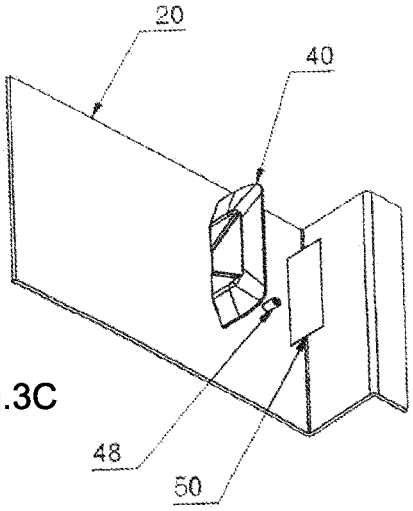
FIG. 3C the arrangement of the FIG. 3A.
Figure 3D:
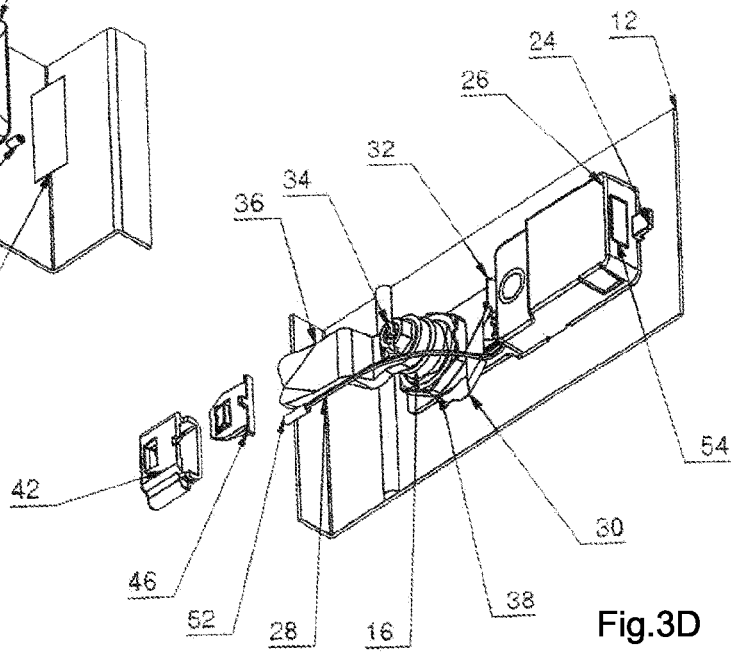
FIG. 3D the arrangement according to FIG. 3B in each case in an exploded view.

FIG. 1 shows a closure system 10 constructed according to the invention, which is mounted in a door leaf 12 and engages behind a door frame 20. The closure 10 includes a closure housing or rotary latch housing 16 with a flange, having a LED in the region of the lens 14. By the actuation 18, by means of a sliding shoe, the tongue 36 can be pivoted, so that it either does or does not engage behind the frame batten 20, as shown in FIG. 1. The arrangement according to the invention also has the normal seal 22, which is also shown in FIGS. 2B and 2C. It is also possible to identify in FIG. 2C and FIG. 5C a sliding ramp 40, on which the tongue 36 or the sliding shoe 42 slides, if the closure is closed. On a base plate 24 in FIGS. 2A, 2B and 2C a module is provided for signal processing, which is protected by a module cover 26. By means of a plug-in connection 32, the module is connected with the other parts of the electronics of the closure and in this way controls a diode, the light from which identifiably passes through the lens 14. By way of example, the light can indicate the open switch. According to FIGS. 2B, 2C the sensor cable 28 passes a signal from the sensor, which here is accommodated in the sliding shoe 42, to the data processing device with the cover 26. Here, the sliding ramp 40 is affixed to the frame side of the door frame by means of an adhesive film 50, see the arrangement of 3C with the sliding ramp 40 prior to affixing.

Figure 4A:
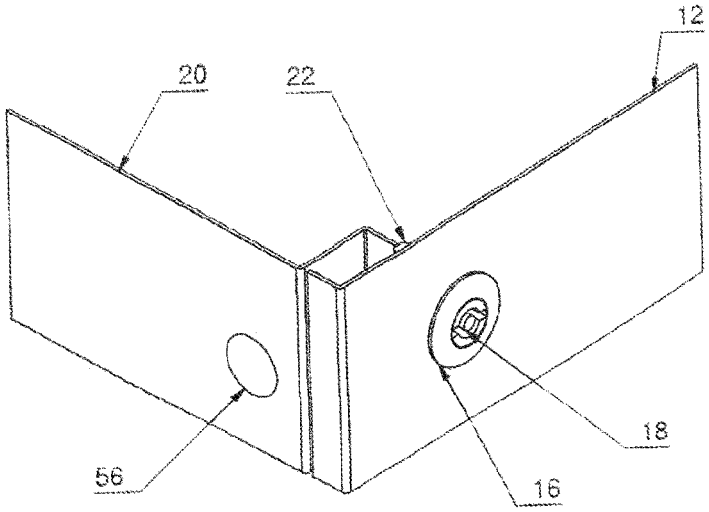
FIG. 4A the closure according to the invention on a different mounted position on the cabinet, from the front.
Figure 4B:
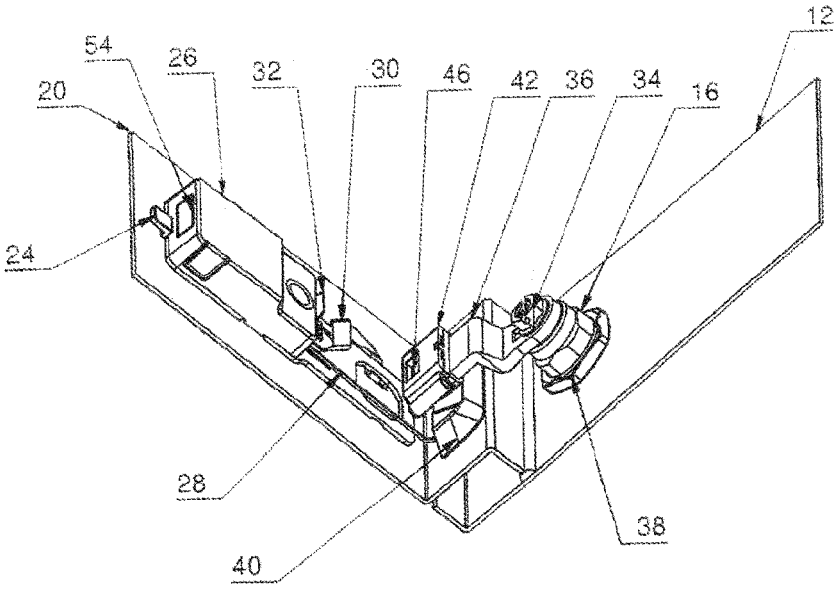
FIG. 4B as above, from behind.

In the sliding ramp 40 there is a recess for accommodating alternatively a magnetic field sensor acting in a contactless manner or a magnet, that is, an embodiment according to FIG. 1, 2A to 2C, 3A to 3D (magnetic field sensor in the sliding shoe 42) or FIG. 4A, 4B, 5A to SD (magnetic field sensor in the sliding ramp 40, magnet in the sliding shoe).

According to a further embodiment, the actuation 18 can also be designed so that the position of the locking unit (tongue 36 or similar) is interrogated resulting in clear conclusions being drawn on the status of the closure. The tongue 36 is then positioned so that a rotation about the longitudinal axis is inhibited and the detection can take place without errors.

According to another embodiment still, the closure unit 46 is combined with the electronics box 48 to form a single housing unit, containing the components, avoiding the need for a division into a latch 46 and bar magnet 48.

Sliding shoe for the tongue 36

According to another embodiment still, a sliding shoe is used for the tongue 36, which works with a sliding ramp 40, mounted in the frame of the industrial cabinet. The ramp contains a magnet 48, see FIG. 2 and FIG. 3, a sensor 52 is in the sliding shoe, see FIG. 2, for the tongue 36 and a sliding ramp 40 is mounted in the frame of the industrial cabinet. The ramp contains a magnet 48, which is detected by a sensor 52 in the sliding shoe, so that an evaluatable signal on the locking status of the door is generated.

Opening procedure

The opening procedure takes place as follows:

An enabling process is carried out, to be able to operate the latch 46. Through a permitted medium, by way of example with an RFID card, the access permission is read out and the latch 46 unlocked. The closure can then be operated. In one embodiment, the system statuses can be represented optically by means of a coloured lamp 54.

Figure 9:
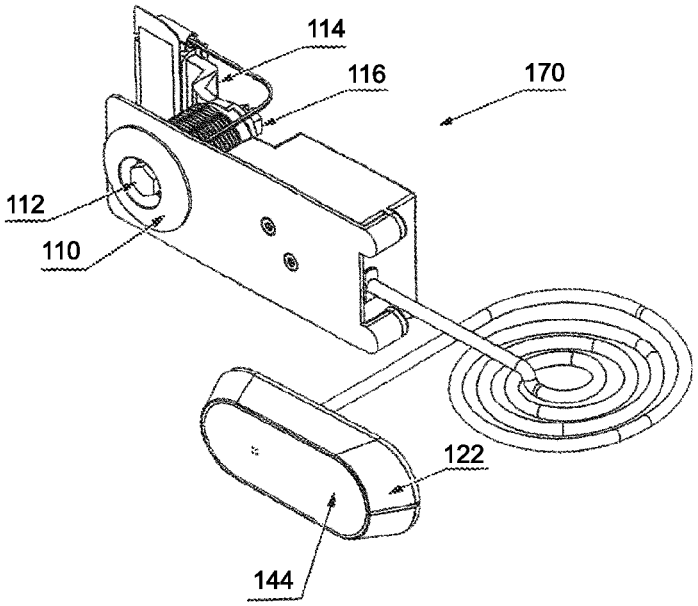
FIG. 9 a perspective view of the electromechanical closure according to the invention FIG. 10 an exploded view of the arrangement according to FIG. 9.
Figure 10:
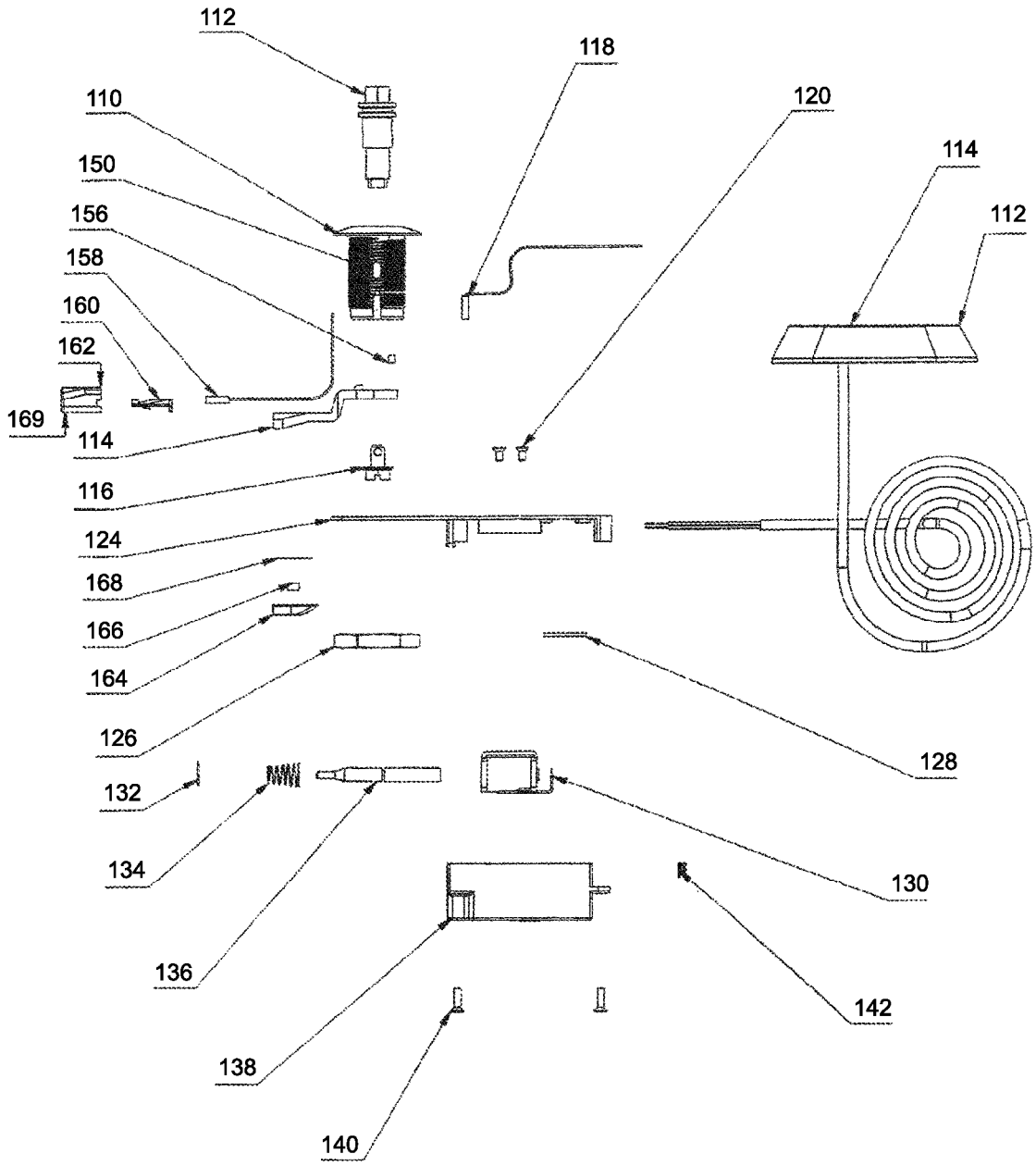
Figure 13:
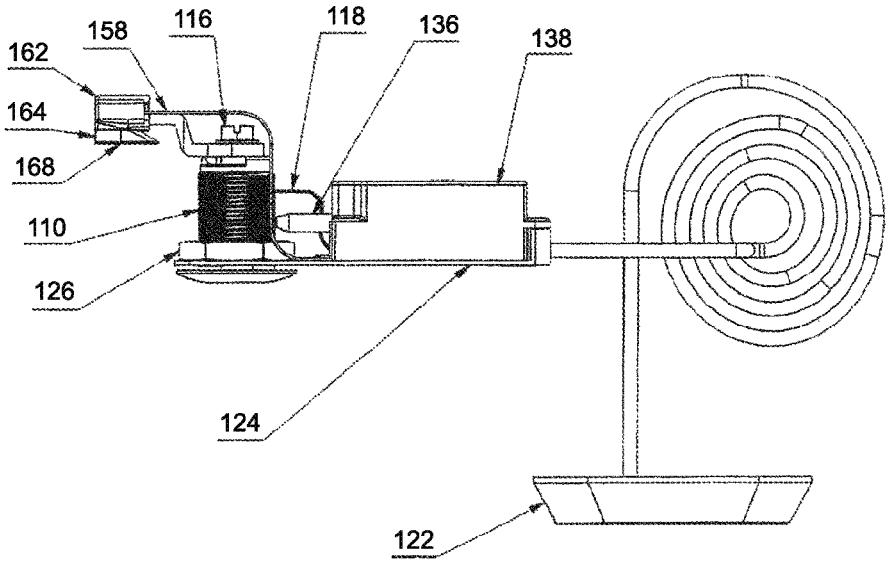
FIG. 13 a side view of the arrangement according to FIG. 9.

FIG. 9 shows an electromechanical closure 170 constructed according to the invention, comprising a housing 110 in which an actuation 112 is supported so that it can rotate through 90 degrees, which actuation at one end is in the form of a polygon, such as a hexagon, and at the other supports a tongue 114. By way of example, the securing of the tongue 114 on the actuation takes place by means of a ratchet screw 116, see also FIG. 10, which provides an exploded view of the components of FIG. 9.

In place of the rotary latch closure 114, what is known as a compression latch can also be used, in which part of the rotation is converted into an axial movement of the tongue (not shown).

Authorisation unit

For the authorisation unit 144, e.g. for the unlocking entity, by way of example an outdoor antenna 122 is used. This antenna 122 detects (recognises) a learned RFID unit and reads out the values stored in this unit. The data are evaluated by a read unit, which checks the access permission. However, instead of this, a fingerprint sensor can be used to identify the person seeking access, as in the prior art.

According to a further embodiment an authorisation unit 144 can provide a radio module or optionally a unit for contactless energy transmission, as described in a parallel application No 20 2016 003 588.7.

Closure unit

For the mechanical closure unit 146, see FIG. 11A, preferably a rotary latch closure or compression latch is used. The closure unit 146 is mechanically operated, using a socket spanner, which can be placed on the polygon 112, see FIG. 11B, whereupon a rotation of the rotary latch or, in the compression closure form, an occasional axial translation takes place. For blocking the rotation or enabling by an electromechanical component 148 a pin or plunger 136 is used. For the purpose of autonomy, the housing 110 is provided with an elongated hole, as shown in FIG. 11B, through which the plunger 136 is able to plunge into the housing 110. An actuation 112 is blocked, if the plunger 136 is able to extend through the elongated hole 150, see FIG. 12, into a groove 152 on the actuation 112.

E-Box

Figure 14:
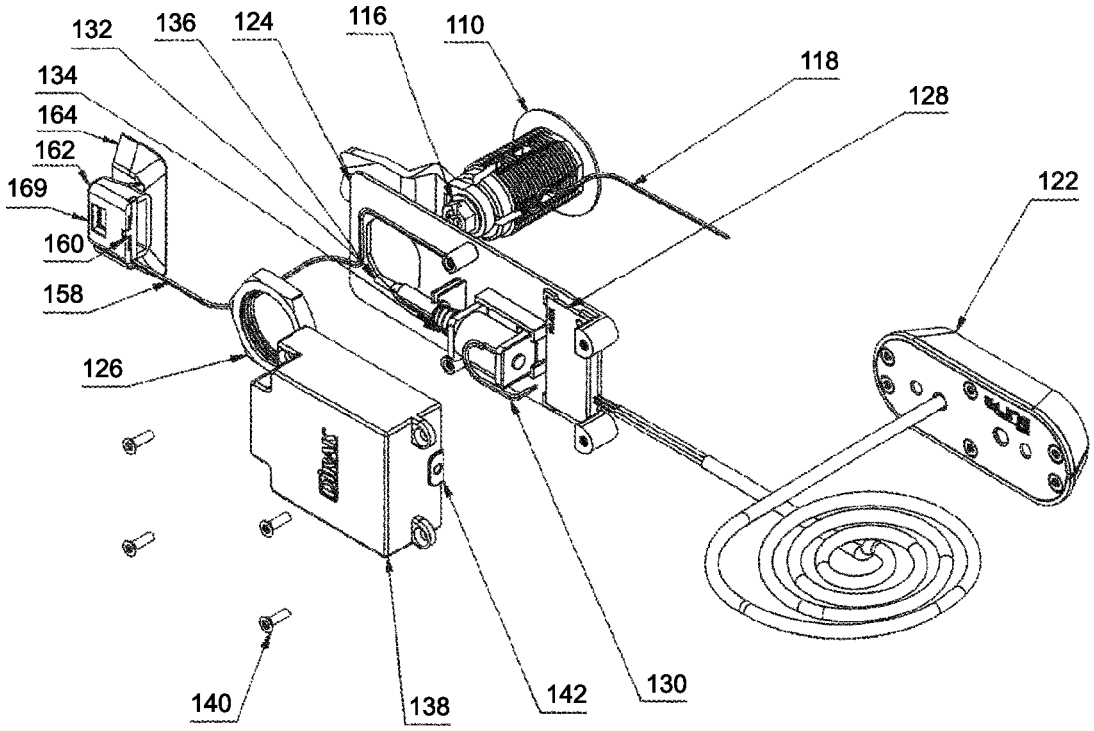
FIG. 14 an exploded view of the arrangement of FIG. 11B.

The abovementioned FIG. 11A also shows an electronics box (E-box) 148, comprising electronics (printed) 128, see FIG. 11B, for switching the system, an electromechanical unit 130, by way of example a lifting magnet or a servomotor for switching the blocking function and one or more sensors 118, 158, see FIG. 14, wherein the sensor preferably includes a magnetic field sensor acting in a contactless manner, by way of example in the form of a read sensor, which detects the state of the blocking device. The system is encapsulated by a protective enclosure 138, shown in FIG. 14, and protected from external influences. In a further embodiment, the entire system, as shown, consists of the individual system components of authorisation unit 144, closure unit 146 and E-box 148, wherein the sensor technology 118 is accommodated in the housing 110 of the closure unit 146 and thus the sensors 118 are able to detect the position of the closure, and thus whether the closure of the rotary latch is in the locking position, in which the door is held closed, or in a position allowing opening of the door.

INDUSTRIAL APPLICABILITY

The industrial applicability of the invention is in switch cabinet construction.

While several examples of the invention are shown in the accompanying figures and described in detail hereinabove, other aspects will be apparent to, and readily made by, those skilled in the art without departing from the scope and spirit of the disclosure. Accordingly, the foregoing description is intended to be illustrative rather than restrictive. The invention described hereinabove is defined by the appended claims and all changes to the invention that fall within the meaning and range of equivalency of the claims are to be embraced within their scope.

REFERENCE NUMBERS

10 Closure system
12 Door leaf
14 Lens
16 Rotary latch housing
18 Actuation
20 Frame sheet
22 Seal
24 Base plate
26 Module cover
28 Sensor cable
30 Film cable
32 Plug-in connection
34 Fastening screw
36 Tongue
38 Hexagonal nut
40 Sliding ramp
42 Sliding shoe
44 Adhesive film
46 Latch
48 Bar magnet
50 Adhesive film
52 Read sensor
54 Breakout window
56 Deflector
58 Insertion ramp
60 Withdrawal protection means
62 Insertion sliding shoe
110 Housing
112 Actuation
114 Tongue
116 Self-locking screw
118 Sensor
120 Screw
124 Attachment plate 1
126 Hexagonal nut
128 Printed circuit board
130 Lifting magnet
132 Lock washer
134 Compression spring
136 Plunger, locking
138 Cap
140 Screw
142 Cable routing
144 Authorisation unit
146 Closure unit
148 E-box
150 Elongated hole
152 Groove
154 Signal LED
156 Magnet
158 Sensor
160 Latch
162 Housing
164 Sliding ramp
166 Magnet
168 Adhesive film
169 Sliding shoe
170 Electromechanical closure

The invention claimed is:

1. A closure system, comprising a locking arrangement and a sliding shoe, wherein the locking arrangement comprises a rotary latch and is configured to control a display device to indicate the blocking of the closure, wherein the rotary latch comprises a locking tongue, wherein the sliding shoe is placed on the locking tongue of the rotary latch mounted in a door, for running onto a sliding ramp supported by a door frame, and wherein the sliding shoe comprises a sliding shoe housing with a recess for the insertion of one of a magnet or a magnetic field sensor acting in a contactless manner.

2. The closure system according to claim 1, wherein the sliding ramp comprises a recess for accommodating one of the magnet or the magnetic field sensor configured to act in a contactless manner.

3. The closure system according to claim 1, wherein the sliding ramp comprises a sliding ramp housing, wherein the sliding ramp has an adhesive surface on a frame side of the sliding ramp housing, wherein the sliding ramp housing is affixed to the door frame by means of the adhesive surface on the frame side of the sliding ramp housing.

4. The closure system according to claim 1, wherein at least one of the door or the door frame retains a base plate supporting a LED and LED control electronics, wherein the LED and LED control electronics are configured to indicate the convergence of the magnet and the magnetic field sensor by means of a light signal providing an indication of the position of the tongue on the ramp.

* * * * *